US009638219B2

(12) United States Patent
Furuse

(10) Patent No.: US 9,638,219 B2
(45) Date of Patent: May 2, 2017

(54) METHOD OF CONTROLLING HYDRAULIC SYSTEM AND HYDRAULIC SYSTEM

(71) Applicant: Mitsubishi Aluminum Co., Ltd., Tokyo (JP)

(72) Inventor: Hideki Furuse, Susono (JP)

(73) Assignee: Mitsubishi Aluminum Co., Ltd., Tokyo (JP)

( * ) Notice: Subject to any disclaimer, the term of this patent is extended or adjusted under 35 U.S.C. 154(b) by 365 days.

(21) Appl. No.: 13/738,075

(22) Filed: Jan. 10, 2013

(65) Prior Publication Data

US 2013/0118221 A1 May 16, 2013

(30) Foreign Application Priority Data

Jun. 30, 2010 (JP) ..... 2010-149316

(51) Int. Cl.

| | |
|---|---|
| ***F15B 15/00*** | (2006.01) |
| ***B21C 23/00*** | (2006.01) |
| ***B21C 23/21*** | (2006.01) |
| ***B21C 26/00*** | (2006.01) |
| ***B21C 25/02*** | (2006.01) |
| ***F15B 11/04*** | (2006.01) |

(52) U.S. Cl.

CPC ..... *F15B 15/00* (2013.01); *B21C 23/00* (2013.01); *B21C 23/211* (2013.01); *B21C 25/02* (2013.01); *B21C 26/00* (2013.01); *F15B 11/0406* (2013.01)

(58) Field of Classification Search

CPC . F15B 9/04; F15B 15/00; B21C 23/21; B21C 23/211; B21C 26/00; B21C 31/00; B21C 23/00

USPC ..... 60/445–452; 72/253.1, 271, 273, 453.01, 72/453.06, 453.1, 453.14, 453.18

See application file for complete search history.

(56) References Cited

U.S. PATENT DOCUMENTS

| | | | | |
|---|---|---|---|---|
| 8,011,219 | B2 * | 9/2011 | Hagen et al. | 72/264 |
| 2011/0271667 | A1 * | 11/2011 | Schaber | 60/327 |

FOREIGN PATENT DOCUMENTS

| | | | |
|---|---|---|---|
| JP | 60-250821 | A | 12/1985 |
| JP | 04-160205 | A | 6/1992 |

(Continued)

OTHER PUBLICATIONS

Notice of Allowance issued Apr. 1, 2014 in Japanese Patent Application No. 2010-149316 (with English language translation).

*Primary Examiner* — Edward Tolan

(74) *Attorney, Agent, or Firm* — Oblon, McClelland, Maier & Neustadt, L.L.P.

(57) ABSTRACT

A method of controlling a hydraulic system, the hydraulic system including a ram cylinder unit having a cylinder and a ram, and a hydraulic pump and a reservoir used to supply hydraulic fluid to the cylinder, and hydraulically driving the ram using the hydraulic fluid so as to move against a specific load, the method includes determining what a present state is one of an initial state, a proportional steady state, and a later state, controlling the pumping rate, which is obtained by adding the flow rate corresponding to the volume loss due to the compression of the hydraulic fluid thereto, to control the ram in the initial state, and controlling the pumping rate, which is obtained by subtracting the flow rate corresponding to volume recovery of the hydraulic fluid due to the relief of compression of the hydraulic fluid therefrom, to control the ram in the later state.

4 Claims, 8 Drawing Sheets

(56) References Cited

FOREIGN PATENT DOCUMENTS

| | | | |
|---|---|---|---|
| JP | 2000-087907 | A | 3/2000 |
| JP | 2000-222002 | | 8/2000 |
| JP | 2002-147405 | A | 5/2002 |
| JP | 2003-048016 | A | 2/2003 |
| JP | 2003-156005 | A | 5/2003 |

* cited by examiner

METHOD OF CONTROLLING HYDRAULIC SYSTEM AND HYDRAULIC SYSTEM

BACKGROUND OF THE INVENTION

Field of the Invention

The present invention relates to a method of controlling a hydraulic system which is applied to a ram type extrusion device or the like used to extrude a metal material such as aluminum, and to a hydraulic system.

Description of the Related Art

As an apparatus for extruding a metal material such as aluminum, a ram type extrusion device has been known which includes a tubular container receiving an unwrought metal (billet) such as aluminum, a die attached to an exit side of the container, and a ram cylinder unit connected to an entrance side of the container.

This ram type extrusion device is known as a type of hydraulic apparatus that receives, for example, an unwrought aluminum in the container, that presses a ram of the ram cylinder unit into the container from the rear side of the container, that pushes the billet to the die under high temperature and high pressure, and that processes the billet to a product of a desired shape by extrusion through a die hole formed in the die.

In this extrusion device, when the extruding speed of the billet passing through the die is higher than necessary, the surface of an extruded product of aluminum may be roughened or cracks may be formed, whereby the extruded product may become defective. Accordingly, from the viewpoint of productivity, it is preferable that the extruding speed of the billet be set as high as possible without causing a defective product and that the extruding speed of the billet be made to reach a target speed fast and become stabilized.

Therefore, when operating the extrusion device, it is possible to achieve uniformization of the extruding speed of the billet by setting the target value of the extruding speed and controlling the pressure or the speed of the ram causing the billet to move. However, it is not easy to control the extruding speed due to the variation in extrusion resistance between the initial period of extrusion and the later period of extrusion based on the amount of billet remaining, the influence of conditions unique to the extrusion device, and the like. Accordingly, control of the extruding force or the extruding speed of the ram cylinder unit is an important factor in operating the extrusion device.

As an example of a control technique of the extrusion device, a PID control method is known as a control method of a ram cylinder unit.

Japanese Unexamined Patent Application, First Publication No. 2000-222002 discloses a control parameter determining device that includes a storage part storing presence time for each of plural operating value sections which are partitioned depending on the magnitudes in an extended PID control technique, means for adding the presence time to the storage parts of an operating value section corresponding to the acquired operating value to be controlled and an operating value section smaller than the operating value section, and determination means for determining initial parameters relevant to the initial operating value based on the largest operating value section of the operating value sections of which the presence time stored in the storage part is larger than a threshold value.

In the method of controlling the ram cylinder unit using the PID control technique, the speed of the ram of the ram cylinder unit is controlled to be a target value lower by a predetermined margin than the critical point between a non-defective product and a defective product. In the PID control, the speed is controlled to reach the target value as fast as possible in the transition period which is the initial period of control. In a steady state after the speed reaches the target value, the speed is controlled to maintain the target value without changing the control value.

However, in the PID control, particularly, in the transition period, a proportional operation of controlling an input gain of the ram cylinder unit is performed based on the difference between the target value and the actual value of the control value such that the operating value becomes larger when the difference becomes larger and the operating value becomes smaller when the difference becomes smaller.

For example, in the PID control, the P operation is to acquire the difference between the target speed and the present speed of the ram and to set the output to be large so as to obtain an output proportional to the difference when the difference between the target speed and the present speed is large. The I operation is to set the output to be large so as to obtain the output proportional to the integral of the difference when it is hard to raise the present speed to the target speed. The D operation is to control the output in the direction in which the rapid variation of the difference is suppressed so as to obtain the output proportional to the differential of the difference between the target speed and the present speed of the ram.

That is, the PID control is a control method such as trial-and-error control in consideration of the difference between the target value and the actual value. Accordingly, when the input gain of the ram cylinder unit is small, there is a problem in that the present speed barely reaches the target speed. When the input gain of the ram cylinder unit is large, there is a problem in that overshoot is caused or a variation in the output value called hunting is caused. There is also a problem in that it is not easy to appropriately match the input gain of the ram cylinder unit.

In the control method described in JP2000-222002A, control having fuzzy control and a learning function combined therein is performed. This method is basically feedback control. Accordingly, when an aluminum material is first extruded under different conditions, the adjustment is difficult. In the second or subsequent control using the same material, a learning effect is exhibited and the accuracy is improved to a certain degree. However, since this is a control method of performing control in a state of trial-and-error in consideration of the state, the speed of the ram barely reaches the target speed. Accordingly, there is a tendency that the problem with overshoot or hunting in addition to the problem with the slow response is not solved.

In the control method described in JP2000-222002A, the conditions in the control of second or subsequent extruding are different from the previous ones, when the billet temperature, the die temperature, and the billet length are changed. Accordingly, there is a problem in that the previous learning effect is not exhibited and the control method conclusively becomes a control method which is in a state of trial-and-error.

SUMMARY OF THE INVENTION

The inventor actively studied control conditions of an extrusion device having a ram cylinder unit in consideration of the above-mentioned circumstances and found knowledge that parameters which had not been considered in the past in addition to the extruding conditions known in the past are important.

As known widely, an extrusion device is a type of hydraulic system using a hydraulic ram cylinder unit capable of generating a strong pressure of several thousand tons and includes a hydraulic mechanism for generating a high pressure. In order to operate the hydraulic ram cylinder unit, hydraulic fluid is supplied to the ram cylinder by the use of a hydraulic pump to generate a high hydraulic pressure. In the ram cylinder unit for generating a high hydraulic pressure, there is a problem in that the ram is not responsively operated by the hydraulic pressure, and volume loss is caused until the ram is actually operated after the hydraulic fluid for operating the ram is compressed.

That is, when the hydraulic fluid is compressed by the high pressure, the moving speed of the ram is not simply directly proportional to the increase or decrease of the hydraulic pressure. For example, in the period of time where the hydraulic fluid is compressed in the initial step of extrusion, there is a problem in that the moving speed of the ram increases slowly even when the hydraulic pressure is increased. For example, when the amount of remaining billet decreases in the latter half of the extrusion process, the movement resistance of the ram is reduced. Accordingly, as a result of relief of the hydraulic pressure having been applied to the hydraulic fluid due to compression, an unexpected high hydraulic pressure may arise.

In addition to the compression and relief of the hydraulic fluid, the repetition of expansion and contraction of the cylinder, the hydraulic pipe, the container unit (the inner peripheral wall thereof), or the like depending on the hydraulic state may be the influencing factors. In the control method in the related art, such influence is not considered at all. However, it was verified through the inventor's study that such factors affect the controllability of the extrusion device.

By considering the influence of expansion and contraction of the cylinder unit and the influence of expansion and contraction of the hydraulic pipe, the container unit, and the like, it was found that the same problems as described above are caused in general hydraulic instruments in which the operation of the ram is controlled using a hydraulic pressure, without being limited to the extrusion device. Accordingly, the knowledge found by the inventor can be applied to hydraulic control devices having any structure.

By finding that the compression of hydraulic fluid itself by a high pressure, the expansion of a cylinder and a hydraulic pipe by a hydraulic pressure, and the like have a large influence on the controllability of a hydraulic system and controlling the operation of the hydraulic system in consideration of these states, an object of the invention in consideration of the above-mentioned circumstances is to provide a method of controlling a hydraulic system, which can control a hydraulic system such as an extrusion device with follow-up performance still higher than that of the past control method and can accurately control an extruding process while satisfactorily absorbing conditions in spite of differences in various conditions such as a difference in material used in the process and a difference in temperature, and a hydraulic system.

Another object of the invention is to provide a method of controlling a hydraulic system, which can be applied to any hydraulic system having a hydraulic pipe or a cylinder without being limited to an extrusion device and can accurately control a force to be generated by the hydraulic system without being affected by the conditions which affected the past hydraulic systems, and a hydraulic system.

According to an aspect of the invention, there is provided a method of controlling a hydraulic system, the hydraulic system including: a ram cylinder unit having a cylinder and a ram; and a hydraulic pump and a reservoir used to supply hydraulic fluid to the cylinder, and hydraulically driving the ram using the hydraulic fluid supplied to the cylinder by the hydraulic pump so as to cause the ram to move against a specific load, the method including: determining what a present state is one of an initial state, a proportional steady state, and a later state, wherein the initial state is a state where the hydraulic pump supplies the hydraulic fluid to the cylinder to compress the hydraulic fluid in the cylinder and to control the moving speed of the ram by the use of the pressure of the hydraulic fluid including volume loss due to the compression, the proportional steady state is a state where a predetermined correlation is maintained depending on a pumping rate supplied to the cylinder and the moving speed of the ram is controlled after the compression of the hydraulic fluid in the cylinder is completed, and the later state is a state where the pressure decreasing by decompressing the hydraulic fluid compressed in the cylinder is added to the pressure of the hydraulic fluid supplied to the cylinder and the moving speed of the ram is controlled by the use of the resultant pressure; controlling the pumping rate, which is obtained by adding the flow rate corresponding to the volume loss due to the compression of the hydraulic fluid thereto, to control the moving speed of the ram to a target ram speed in the initial state; and controlling the pumping rate, which is obtained by subtracting the flow rate corresponding to volume recovery of the hydraulic fluid due to the relief of compression of the hydraulic fluid therefrom, to control the moving speed of the ram to the target ram speed in the later state.

The compressed state in the initial state may be numerically calculated based on the relationship between the pumping rate and the ram speed in the proportional steady state and the relationship between the pumping rate and the ram speed in the initial state, and the pumping rate with respect to the target ram speed may be calculated based on the calculated compressed state.

The compressed state in the later state may be numerically calculated based on the relationship between the pumping rate and the ram speed in the proportional steady state and the relationship between the pumping rate and the ram speed in the later state, and the pumping rate with respect to the target ram speed may be calculated based on the calculated compressed state. Here, the compressed state includes not only the compression of the hydraulic fluid, but also the expansion of the cylinder, the hydraulic system, and the container unit.

The pumping rate corresponding to the present ram speed may be calculated based on the relationship between the moving speed of the ram and the pumping rate, which is expressed as the correlation in the proportional steady state which has been calculated in advance through a test under the specific load condition acting on the ram.

The hydraulic system may be an extrusion device which includes a container unit receiving a billet of a metal material for extrusion, a die unit for extrusion disposed on the front side of the container unit, a cylinder unit having a cylinder and a ram disposed on the rear side of the container unit, and a hydraulic pump and a reservoir supplying the hydraulic fluid to the cylinder unit and in which the ram is hydraulically driven by the hydraulic fluid supplied to the cylinder by the use of the hydraulic pump so as to be advanced and retracted relative to the container unit.

According to another aspect of the invention, there is provided a hydraulic system including: a cylinder unit having a cylinder and a ram; a hydraulic pump and a reservoir being used to supply hydraulic fluid to the cylinder; and a control unit controlling the pumping rate of the hydraulic fluid supplied from the hydraulic pump to the cylinder, wherein the ram is hydraulically driven using the hydraulic fluid supplied to the cylinder by the hydraulic pump and the ram is made to move against a specific load, and wherein the control unit determines what a present state is one of an initial state, a proportional steady state, and a later state, where the initial state is a state where the hydraulic pump supplies the hydraulic fluid to the cylinder to compress the hydraulic fluid in the cylinder and to control the moving speed of the ram by the use of the pressure of the hydraulic fluid including volume loss due to the compression, the proportional steady state is a state where a predetermined correlation is maintained depending on a pumping rate supplied to the cylinder and the moving speed of the ram is controlled after the compression of the hydraulic fluid in the cylinder is completed, and the later state is a state where the pressure decreasing by decompressing the hydraulic fluid compressed in the cylinder is added to the pressure of the hydraulic fluid supplied to the cylinder and the moving speed of the ram is controlled by the use of the resultant pressure; wherein the control unit controls the pumping rate, which is obtained by adding the flow rate corresponding to the volume loss due to the compression of the hydraulic fluid thereto, to control the moving speed of the ram to a target ram speed in the initial state, and wherein the control unit controls the pumping rate, which is obtained by subtracting the flow rate corresponding to volume recovery of the hydraulic fluid due to the relief of compression of the hydraulic fluid therefrom, to control the moving speed of the ram to the target ram speed in the later state.

The control unit may numerically calculate the compressed state in the initial state based on the relationship between the pumping rate and the ram speed in the proportional steady state and the relationship between the pumping rate and the ram speed in the initial state, and may calculate the pumping rate with respect to the target ram speed based on the calculated compressed state.

The control unit may numerically calculate the compressed state in the later state based on the relationship between the pumping rate and the ram speed in the proportional steady state and the relationship between the pumping rate and the ram speed in the later state, and may calculate the pumping rate with respect to the target ram speed based on the calculated compressed state. The calculations of the compressed state in the initial state and that in the later state are identical.

The control unit may calculate the pumping rate corresponding to the present ram speed based on the relationship between the moving speed of the ram and the pumping rate, which is expressed as the correlation in the proportional steady state.

The hydraulic system may be an extrusion device which includes a container unit receiving a billet of a metal material for extrusion, a die unit for extrusion disposed on the front side of the container unit, a cylinder unit having a cylinder and a ram disposed on the rear side of the container unit, and a hydraulic pump and a reservoir supplying the hydraulic fluid to the cylinder unit and in which the ram is hydraulically driven by the hydraulic fluid supplied to the cylinder by the use of the hydraulic pump so as to be advanced and retracted relative to the container unit.

According to the method of controlling a hydraulic system and the hydraulic system, by paying attention to the initial state where volume loss occurs due to the compression of a hydraulic fluid in a cylinder and the later state where an additional pressure occurs due to the relief of the compressed hydraulic fluid in the hydraulic system including the cylinder unit and the hydraulic pump, the pumping rate is controlled in consideration of the volume loss and the additional pressure, the amount of hydraulic fluid suitable for movement of the ram is supplied from the hydraulic pump to the cylinder in the initial state and the later state, and the moving speed of the ram is appropriately controlled in consideration of the influence of the compression and relief of the hydraulic fluid. Accordingly, compared with the PID control which has been used from the past, it is possible to accurately control the moving speed of the ram without causing overshoot or the like.

According to the method of controlling a hydraulic system and the hydraulic system, by controlling the present hydraulic pumping rate, the present ram speed-corresponding hydraulic pumping rate, the target ram speed-corresponding hydraulic pumping rate, and the flow rate command of the hydraulic pump to satisfy the relationship expressed as a simple equation, it is possible to control the moving speed of the ram. Accordingly, it is possible to control the moving speed of the ram without performing complicated calculations or control like the PID control and without causing overshoot due to an increase in difference like the fuzzy control, thereby easily and accurately controlling the ram speed.

The invention can be applied to any extrusion device having a cylinder unit. Accordingly, even when the billet temperature, the die temperature, and the billet length are changed during the extruding process, it is possible to accurately control the ram speed without being affected by the changes.

As a result, compared with the PID control or the fuzzy control in the related art, it is possible to more accurately control the ram speed. By applying the invention to an extrusion device, it is possible to manufacture an extruded molded product having no defect at higher productivity than in the related art.

DETAILED DESCRIPTION OF THE INVENTION

Hereinafter, the invention will be described in detail based on an embodiment shown in the accompanying drawings, but the invention is not limited to the embodiment to be described below.

Figure 1:
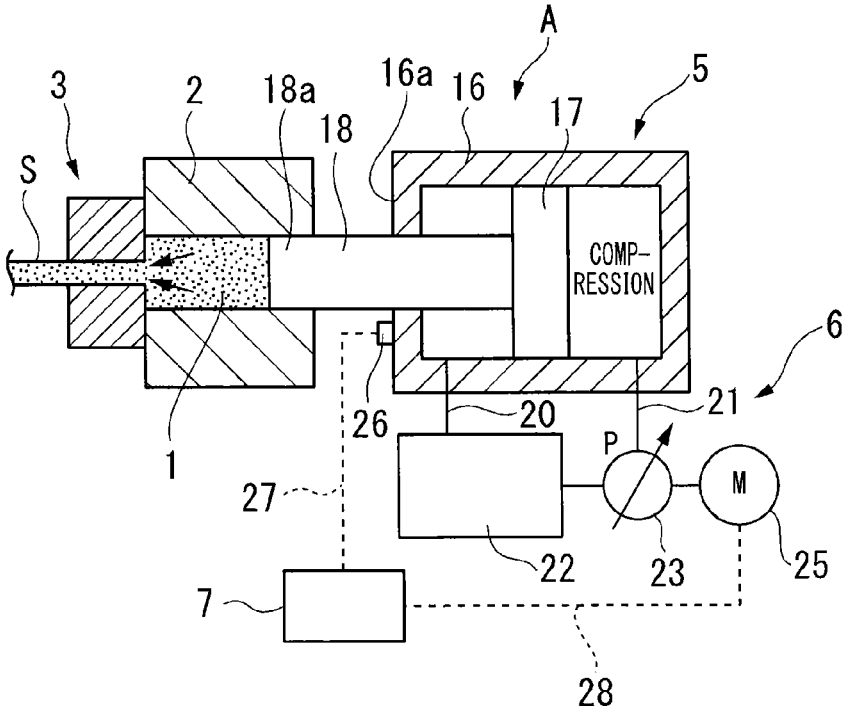
FIG. 1 is an entire constitutional diagram illustrating an initial processing state where an extruding process is performed using an extrusion device employing a hydraulic system according to an embodiment of the invention.
Figure 2:
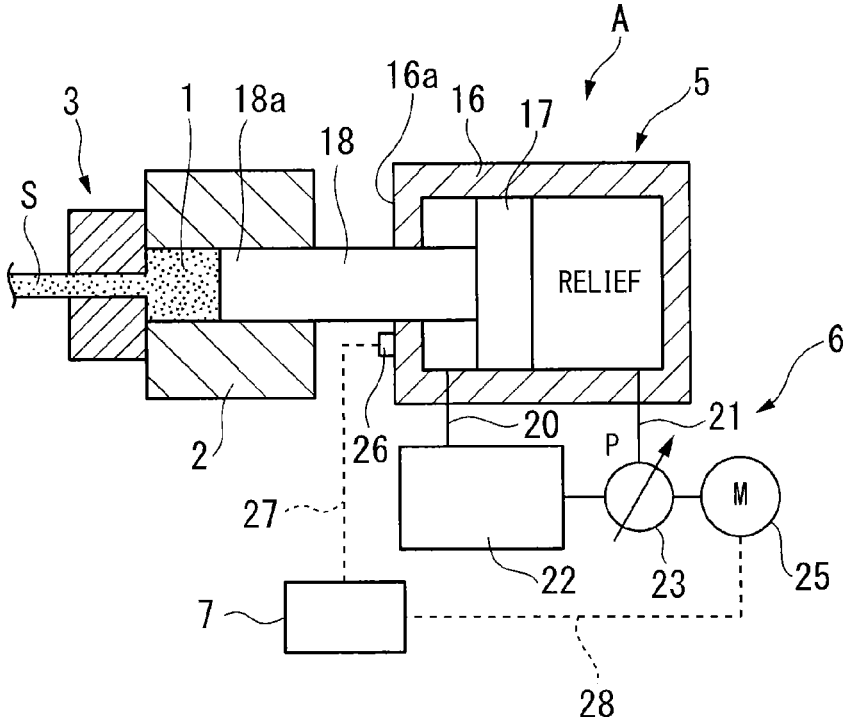
FIG. 2 is an entire constitutional diagram illustrating a later processing state where an extruding process is performed using the extrusion device employing the hydraulic system according to the embodiment of the invention.

FIGS. 1 and 2 show the entire constitution of an extrusion device employing a hydraulic system according to a first embodiment of the invention. The extrusion device A according to this embodiment includes a thick tubular container unit 2 that receives a billet 1 which is a metal material such as aluminum or an aluminum alloy, a die unit 3 that is disposed on the exit side of the container unit 2, a ram cylinder unit 5 that is connected to the entrance side of the container unit 2, a hydraulic fluid supply unit 6 that supplies or recovers hydraulic fluid to and from the ram cylinder unit 5, and a control unit 7 such as a computer that controls the operation of the hydraulic fluid supply unit 6.

Figure 3:
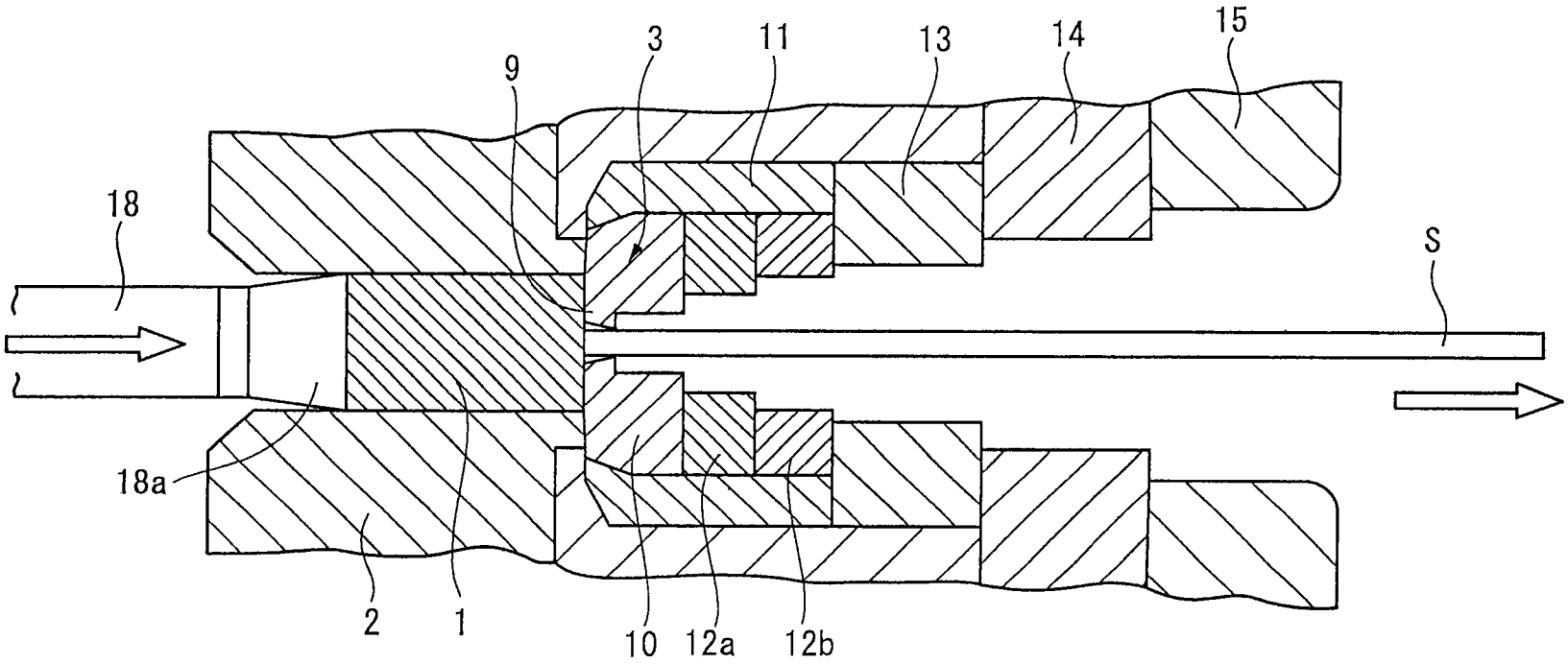
FIG. 3 is a cross-sectional view illustrating the specific structure around a die of the extrusion device shown in FIGS. 1 and 2.

The detailed partial structure of the container unit 2 and the die unit 3 is shown as an example in FIG. 3. A die holder 10 having a die 9 is disposed on the exit side of the container unit 2 which is a thick cylindrical container. The die holder 10 is received in a die ring 11. A backer 12*a* and a back shim 12*b* are received in the inside of the die ring 11 and on the rear side of the die holder 10. A bolster 13, a pusher piece 14, and an end platen 15 are disposed on the rear side of the die ring 11.

In the extrusion device A according to this embodiment, the die 9 disposed in the die unit 3 shown in FIG. 3 is an example, and a structure in which plural dies 9 are disposed or a structure in which the pusher piece 14 is removed may be employed. In any case, the structure of the die unit 3 has only to be configured to have a die 9 having a die hole for extruding a target product on the exit side of the container unit 2 and to perform an extruding process. FIG. 3 shows an example of the constitution. An extruded product S obtained by extruding a billet 1 through the die 9 can be externally extracted through a passage hole of the backer 12*a*, a passage hole of the back shim 12*b*, a passage hole of the bolster 13, a passage hole of the pusher piece 14, and a passage hole of the end platen 15 which are disposed to match the die hole of the die 9.

As shown in FIGS. 1 and 2, in the ram cylinder unit 5, a main ram 17 is movably received in a tubular main cylinder 16. A rod-like ram 18 unified into the front side of the main ram 17 is disposed to be movable in the axis direction (the length direction) of the ram cylinder unit 5 through a front wall 16*a* of the main cylinder 16. The tip 18*a* of the ram 18 can be pressed into the container unit 2 to press the billet 1 received in the container unit 2 toward the die 9. As shown in FIG. 3, an incoming hole is formed on the ram side 18 of the die 9. A die hole capable of processing the billet 1 injected through the incoming hole with a high pressure to a desired product shape is formed in the die 9.

In the main cylinder 16 of the ram cylinder unit 5, pipes 20 and 21 for supplying and discharging hydraulic fluid to and from the cylinder are connected to the peripheral wall on the front side and the peripheral wall on the rear side. The pipe 20 is connected to a reservoir 22. A hydraulic pump 23 is attached to a portion in which the reservoir 22 and the pipe 21 are connected. The operation of the hydraulic pump 23 is controlled by a control motor 25, and the hydraulic pump is configured to adjust a pumping rate (the flow rate at which the hydraulic fluid is supplied to the main cylinder 16 or the flow rate at which the hydraulic fluid is discharged from the main cylinder 16). Therefore, by adjusting the amount of hydraulic fluid to be supplied to the inside of the cylinder in the back of the position of the main ram 17 by the use of the hydraulic pump 23, the main ram 17 can be made to move in the length direction of the main cylinder 16, whereby it is possible to adjust the pressing speed and the pressing length of the ram 18 into the container unit 2. The hydraulic fluid staying in the main cylinder 16 in the front of the position of the main ram 17 can be returned to the reservoir 22 via the pipe 20 with the advancing of the main ram 17.

In the ram cylinder unit 5, a meter 26 that measures the moving speed of the ram 18 is disposed in a part of the outer wall of the main cylinder 16. The meter 26 and the control unit 7 are connected to each other via a connection wire 27. The moving speed of the ram 18 measured by the meter 26 is sequentially input to the control unit 7 as basic information for controlling the ram cylinder unit. The control unit 7 is connected to the control motor 25 via a connection wire 28, and can control the flow rate of the hydraulic fluid to be supplied to the rear side of the main cylinder 16 from the hydraulic pump 23 by controlling the operating state of the control motor 25. The connection wire 27 for transmitting information from the meter 26 to the control unit 7 and the connection wire 28 for supplying an instruction from the control unit 7 to the control motor 25 are not limited to physical wires as shown in FIGS. 1 and 2, but may employ means for transmitting information using communication means such as radio means.

The control unit 7 in this embodiment is configured to control the hydraulic pump flow rate (%) and the moving speed (mm/sec) of the ram 18 as described below.

The control unit 7 is constructed by a computer system having a memory or a storage unit therein. The following information is stored in the storage unit of the control unit 7.

First, control information for controlling the movement of the ram 18 in the initial state of extrusion, control information for controlling the movement of the ram 18 in a proportional steady state thereof, and control information for controlling the movement of the ram 18 in a later state of extrusion are individually stored.

The initial state of extrusion means a state where the hydraulic pump 23 supplies hydraulic fluid to the main cylinder 16 to compress the hydraulic fluid in the main cylinder 16 and to control the moving speed of the ram 18 by the use of the pressure of the hydraulic fluid including the volume loss due to the compression.

The proportional steady state means a state where a predetermined correlation is maintained depending on the magnitude of the pumping rate supplied to the main cylinder 16 and the moving speed of the ram 18 is controlled after the compression of the hydraulic fluid in the main cylinder 16 is completed.

The later state means a state where the pressure of the hydraulic fluid compressed in the main cylinder 16 is released and the volume recovery of the hydraulic fluid due to the relief of the compression is added to the pressure of the hydraulic fluid supplied to the main cylinder 16 to control the moving speed of the ram 18.

The control unit 7 in this embodiment grasps these three states, controls the moving speed of the ram 18 by the use of the pumping rate obtained by adding the volume loss due to the compression of the hydraulic fluid thereto in the initial state, controls the moving speed of the ram 18 by controlling the pumping rate based on a specific proportional relation to be described later in the proportional steady state, and controls the moving speed of the ram 18 by controlling the pumping rate obtained by subtracting the pressure increasing due to the relief of the compressed hydraulic fluid therefrom in the later state.

First, the control in the proportional steady state will be described.

As a relational equation of the pumping rate (%) and the ram speed (mm/sec), the control unit 7 stores a proportional relational equation expressed by Equation 1 in which the pumping rate is defined as y (%: ratio to the maximum pumping rate), the moving speed of the ram is defined as x (mm/sec), and the increasing ratio of the moving speed of the ram 18 with an increase in the pumping rate is approximated by a proportional relation accompanying a proportional constant a.

$$Y=a\times x+c \qquad \text{Equation 1}$$

Here, the relational equation such as y=6.0522×x+21.97 in which constants a and c in Equation 1 are specified with respect to a specific extrusion device A is stored in the control unit 7 in this embodiment.

Figure 4:
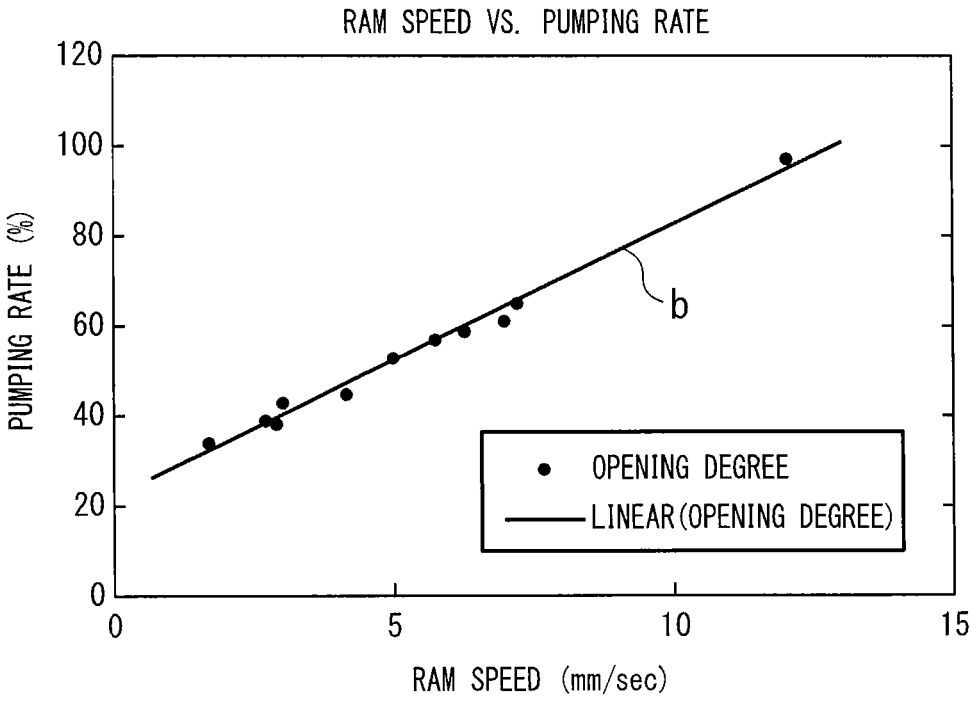
FIG. 4 is a graph illustrating the relationship between a pumping rate and a ram speed in the extrusion device employing the hydraulic system according to the embodiment of the invention.

The constants a and c in the relational equation are obtained from the relationship shown in FIG. 4 by once extruding a desired product, for example, using the extrusion device A shown in FIGS. 1 to 3 and using an aluminum alloy material with a specific composition ratio as a billet and calculating the relationship between the pumping rate (%) and the ram speed (mm/sec) as shown in FIG. 4.

That is, when actually extruding the billet of an aluminum alloy material with a specific composition ratio using the extrusion device A, the relationship between the pumping rate and the moving speed of the ram 18 is measured and the measured values are plotted as shown in FIG. 4. When a segment b is defined by connecting the plural plotted positions obtained at this time, the segment b represents Equation 1. The pumping rate (%) shown in the vertical axis in FIG. 4 represents the relative ratio when the maximum flow rate of the hydraulic pump 23 is defined as 100%. Therefore, the pumping rate (%) actually corresponds to a degree of opening of the hydraulic pump. Accordingly, in FIG. 4, the plotted positions are described as the opening degree.

In the relationship shown in FIG. 4, y=6.0522×x+21.97 and $R^2$=0.988 are obtained. Accordingly, the pumping rate and the moving speed of the ram are directly proportional to each other. The constants of the proportional equation shown in FIG. 4 are constants of a proportional equation derived from test results (to be described later) using the extrusion device A having the constitution shown in FIGS. 1 to 3 and using 6063 alloy defined in the JIS as the billet 1.

The reason why the pumping rate and the ram speed are directly proportional to each other as shown in FIG. 4 will be described below.

In the initial state where a billet 1 of a specific metal material is received in the container unit 2 and the extrusion is started, since very large resistance is generated in the ram 18 deforming the billet 1 in the container unit 2 to pass through the die hole of the die 9, the ram cylinder unit 5 needs to generate a high hydraulic pressure so as to overcome the resistance. Here, even when the hydraulic pump 23 supplies hydraulic fluid to the rear side of the main cylinder 16 via the pipe 21, the ram 18 does not move immediately, but the ram 18 does not move until the hydraulic pressure is accumulated to overcome the resistance.

In addition, for a predetermined time when the hydraulic pump 23 continuously supplies the hydraulic fluid to the rear side of the main cylinder 16, the influence of the pressurization and compression of the hydraulic fluid itself in the main cylinder 16, the influence of the slight expansion of the peripheral wall (outer wall) of the main cylinder 16 and the container unit (the inner peripheral wall), to which the hydraulic fluid is supplied, due to the hydraulic pressure, the influence of the slight expansion of the pipe 21, through which the hydraulic fluid flows, due to the pressure of the hydraulic fluid, and the like collectively occurs in addition to the resistance necessary for causing the billet 1 to pass through the die hole of the die 9. Due to these influences, hydraulic control in consideration of these influences has to be performed as well as simply grasping only the pressing force of the ram 18 necessary for causing the billet 1 to pass through the die hole of the die 9.

Then, the hydraulic fluid is supplied to the main cylinder 16, the compression of the hydraulic fluid in the main cylinder 16 is completed, the possible expansion of the peripheral wall (outer wall) of the main cylinder 16 due to the hydraulic pressure is ended, and the expansion of the pipes or other parts due to the hydraulic pressure is also ended. At this time, the moving speed of the ram 18 is changed to be directly proportional to the amount of the hydraulic fluid supplied from the hydraulic pump 23 to the main cylinder 16. This state is the direct proportional relationship shown in FIG. 4. This relationship is always established in the proportional steady state between the initial state and the later state. As shown in FIG. 4, this relationship is expressed by a simple relational equation. The constants of the relational equation are numerical values unique to the ram cylinder unit 5 used therein. The unique numerical values have only to be calculated once for the ram cylinder unit 5 to be used.

Then, when the extruding process is continuously performed to reduce the amount of billet 1 remaining in the container unit 2 as shown in FIG. 2 after the proportional steady state is maintained, the frictional resistance of the billet 1 in the container unit 2 is reduced. Accordingly, the compressed hydraulic fluid is decompressed to apply a force pressing the ram 18. This state is the later state of extrusion.

The deformation resistance of a metal material is changed depending on its own temperature. That is, the hydraulic control of the ram 18 has to be performed in consideration of the extruding temperature, the pressure of the decompressed hydraulic fluid, the increase or decrease in frictional resistance of the remaining billet 1, and the like in addition to the material of the billet 1.

In addition, the above-mentioned influences are changed depending on the material or size of the cylinder used in the extrusion device A actually used, the material or size of the pipes, the capability of the hydraulic pump 23, and the like.

When the supply of hydraulic fluid by the hydraulic pump 23 is reduced or stopped to at least partially relieve the compressed hydraulic fluid existing in the rear side of the cylinder unit 16, the hydraulic fluid moves in the direction in which the hydraulic fluid is returned to the reservoir 22 via the pipe 21 and the hydraulic pump 23. At this time, the influence of the relief of the highly-compressed hydraulic fluid in the main cylinder 16, the influence of the restoration of the expanded peripheral wall of the main cylinder 16, the influence of the restoration of the expanded pipe 21, and the like collectively occur. Accordingly, even when the supply of hydraulic fluid by the hydraulic pump 23 is reduced, it does not cause a decrease in the moving speed of the ram. Therefore, the hydraulic control is further complicated.

In the extrusion device A according to this embodiment, the relationship between the pumping rate of the hydraulic pump 23 and the moving speed of the ram 18 is controlled in consideration of all the influences of the compression and relief of the hydraulic fluid and the expansion or contraction of the peripheral wall of the pipe or the cylinder to which a hydraulic pressure is applied.

First, the flow rate ejected by the hydraulic pump 23 hardly varies even when the pressure in the main cylinder 16 is high or low. That is, the hydraulic pump 23 can pump the hydraulic fluid corresponding to the instructed flow rate regardless of the magnitude of the pressure in the main cylinder 16.

Here, the flow rate for advancing the ram 18 at the time of compressing the hydraulic fluid is a flow rate obtained by subtracting the flow rate corresponding to the compression of the hydraulic fluid and the flow rate corresponding to the expansion of the outer walls of the pipe 21 or the main cylinder 16 from the pumping rate of the hydraulic pump 23. The flow rate for advancing the ram 18 at the time of relieving the hydraulic fluid is a flow rate obtained by adding the flow rate corresponding to the relief of the compressed hydraulic fluid and the flow rate corresponding to the contraction of the outer walls of the pipe 21 or the main cylinder 16 to the pumping rate of the hydraulic pump 23.

When the extruding process is performed while the pumping rate of the hydraulic pump 23 is maintained constant, because a lot of hydraulic fluid is consumed for compression in the initial state of extrusion and the amount of the hydraulic fluid is insufficient to advance the ram 18, the moving speed of the ram 18 does not increase immediately. Thereafter, when the compression of the hydraulic fluid progresses, the flow rate for pressing the ram 18 out of the pumping rate increases, and thus the moving speed of the ram 18 increases. When the hydraulic fluid is compressed until the hydraulic fluid cannot be compressed any more from the start of the extruding process, the overall pumping rate is consumed as the force for advancing the ram 18. This state is the above-mentioned proportional steady state.

When the extruding process progresses and the amount of billet 1 remaining in the container unit 2 decreases, the resistance of the billet 1 decreases. Accordingly, the compressed hydraulic fluid is partially decompressed and thus the hydraulic pressure corresponding to the relief is added to the pumping rate, whereby a force for causing the ram 18 to move acts. This state is the above-mentioned later state of extrusion.

That is, as shown in FIG. 4, when the horizontal axis is set to the moving speed of the ram, the vertical axis is set to the pumping rate, and a test is carried out using the actual extrusion device A, the moving speed of the ram 18 is changed to be proportional to the magnitude of the pumping rate in the above-mentioned proportional steady state. When this relationship is plotted as shown in FIG. 4, the relationship between the pumping rate and the moving speed of the ram exhibits a proportional relationship increasing or decreasing along the segment b.

In the region of the proportional relationship represented by the segment b in FIG. 4 (i.e., in the proportional steady state), any combinations of the sampled pumping rate and the sampled moving speed of the ram 18 appear on the segment b. Therefore, in the region of the proportional steady state, it can be seen that the fluid can be ejected by the hydraulic pump 23 at a prescribed flow rate regardless of the magnitude of the pressure.

When a direct proportional region represented by the segment b in FIG. 4 exists, a case (initial state) where the ram 18 is made to move while compressing the hydraulic fluid so as to obtain a target stable ram speed and a case (later state) where the ram 18 is made to move while decompressing the hydraulic fluid will be reviewed. The control operations thereof will be described below.

Figure 5:
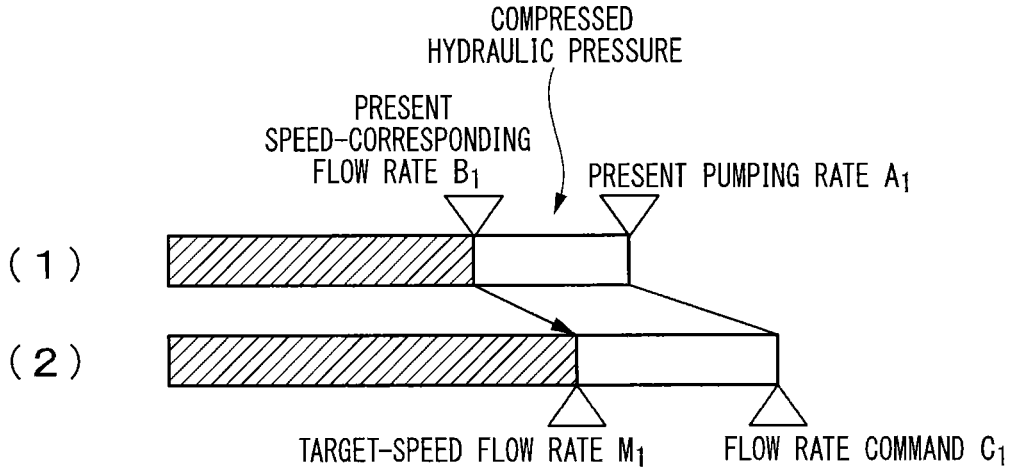
FIG. 5 is a diagram illustrating an example of a control method when a moving speed increases from a present ram speed to a target ram speed in a state where hydraulic fluid is compressed using the extrusion device employing the hydraulic system according to the embodiment of the invention.

When the ram 18 is made to move while compressing the hydraulic fluid, as shown in (1) of FIG. 5, a flow rate obtained by adding the flow rate consumed with the compression of the hydraulic fluid and the flow rate corresponding to the expansion of the outer wall of the pipe and the cylinder and the inner peripheral wall of the container unit to the pumping rate $B_1$ corresponding to the present moving speed of the ram 18 is the present pumping rate $A_1$. On the contrary, when it is intended to obtain a target speed-corresponding flow rate $M_1$, a pumping rate value $C_1$ obtained by adding the flow rate consumed with the compression of the hydraulic fluid and the expansion of the pipe and the cylinder thereto has only to be set as a flow rate command. Here, since the flow rate command $C_1$={(present pumping rate)/(present speed-corresponding flow rate)}×(target speed-corresponding flow rate) is established, the flow rate of the hydraulic pump 23 is controlled to comply with this equation so as to obtain the target speed-corresponding flow rate, whereby it is possible to accurately control the hydraulic pressure in the operation (in the initial state) of compressing the hydraulic fluid.

Therefore, this relational equation used to control the initial state of the ram 18 is stored in the storage unit of the control unit 7.

When the ram 18 is made to move while decompressing the compressed hydraulic fluid (in the later state), as shown in (1) of FIG. 6, a flow rate obtained by adding the flow rate increasing with the relief of the compressed hydraulic fluid and the flow rate corresponding to the contraction of the outer wall of the pipe and the cylinder to the pumping rate $A_2$ corresponding to the present moving speed of the ram 18 is the present speed-corresponding pumping rate $B_2$. On the contrary, when it is intended to obtain the target speed-corresponding flow rate $M_2$, the pumping rate value $C_2$ obtained by excluding the flow rate increasing with the relief of the hydraulic fluid or the contraction of the outer wall of the pipe and the cylinder has only to be set as a flow rate command.

Here, since the relational equation ("ram speed"–"pumping rate") shown in FIG. 4 is established, the flow rate command is $C_2$={(present pumping rate)/(present speed-corresponding flow rate)}×(target speed-corresponding flow rate). Accordingly, when the flow rate of the hydraulic pump 23 is controlled to comply with this equation so as to obtain the target speed-corresponding flow rate, it is possible to accurately control the hydraulic pressure in the operation (in the initial state) of compressing the hydraulic fluid. Since the equation for compression is the same as the equation for relief, it is possible to control the hydraulic pressure using a single equation. Here, the value of present speed-corresponding flow rate/present pumping rate shown in FIG. 5 or the value of present speed-corresponding flow rate/present pumping rate shown in FIG. 6 can be considered as a compression rate of the hydraulic fluid. Therefore, when the compression rate is equal to 1, the pumping rate is the flow rate corresponding to the ram speed. When the compression rate is less than 1, it can be determined that it is a state where the hydraulic fluid is compressed. When the compression rate is greater than 1, it can be determined that it is a state where the hydraulic fluid is decompressed. By further increasing the pumping rate until the stem speed during the compression in the initial state reaches a target value and switching the control to this control before reaching the target value, it is possible to reduce the time until the steady state is reached and to reduce the start-up time.

Therefore, the above-mentioned relational equation to be used for the control of the ram 18 in the later state is stored in the storage unit of the control unit 7.

Figure 6:
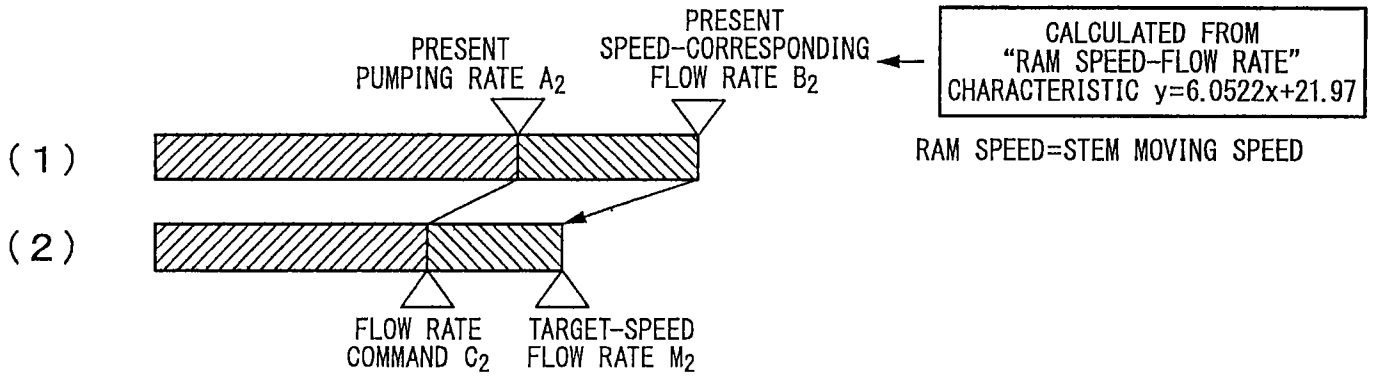
FIG. 6 is a diagram illustrating an example of a control method when a moving speed is lowered from a present ram speed to a target ram speed in a state where the hydraulic fluid is decompressed using the extrusion device employing the hydraulic system according to the embodiment of the invention.

In the extrusion device A according to this embodiment, the relational equation shown in FIG. 4, the relational equation shown in FIG. 5, and the relational equation shown in FIG. 6 are stored in the control unit 7. In the initial state, the control unit 7 controls the moving speed of the ram 18 to be a constant target speed based on the relational equation for the compression of the hydraulic fluid shown in FIG. 5. For example, when the moving speed of the ram 18 does not reach the constant target value due to the influence of the compression of the hydraulic fluid in the initial state of extrusion, the hydraulic fluid is continuously supplied to the main cylinder 16 at the pumping rate in consideration of the flow rate corresponding to the compression of the hydraulic fluid so as for the moving speed of the ram 18 to reach the constant target value.

In the extruding process, the resistance of the extrusion varies depending on the compression or relief of the hydraulic fluid, the material and the length, and the temperature of the billet to be used. Since the hydraulic pressure is high, the expansion of the pipe, the cylinder, and the like occurs. The expansion of constituent members (not shown) such as a tie rod generally included in the extrusion device A, or the like affects the hydraulic control. However, as described above with reference to FIGS. 4, 5, and 6, by controlling the ram speed instead of the pumping rate of the hydraulic pump 23, these complicated influences can be absorbed in the pumping rate and can be integrally controlled.

By employing the control method according to this embodiment as described above, in the extrusion device A including the ram cylinder unit 5, the hydraulic pressure is controlled based on relational equations corresponding to the initial state, the proportional steady state, and the later state by considering that the moving speed of the ram 18 is affected by the highly compression of the hydraulic fluid supplied for the movement of the ram 18 of the ram cylinder unit 5, the influence of the expansion and contraction of the pipe or the cylinder in the supply path of the hydraulic fluid in the ram cylinder unit 5 due to the hydraulic pressure of the hydraulic fluid, the influence of the relief of the compressed hydraulic fluid, and the like and considering the moving speed of the ram 18 and the pumping rate of the hydraulic pump 23. Accordingly, it is possible to control the pumping rate in consideration of the influence of the compression and relief of the hydraulic fluid when performing the extruding process with a high pressure and the influence of the expansion and contraction of the pipe, the cylinder, and the like through which the hydraulic fluid passes and thus to satisfactorily control the moving speed of the ram to a desirable speed.

Therefore, when compared with the PID control in the related art, it is possible to more accurately control the ram speed and to manufacture an extrusion-molded product having no defect with higher productivity.

The control of the initial state, the proportional steady state, and the later state can be applied to general hydraulic systems in which a load acts on the ram cylinder unit 5 and the ram 18 moves against the load.

Figure 7:
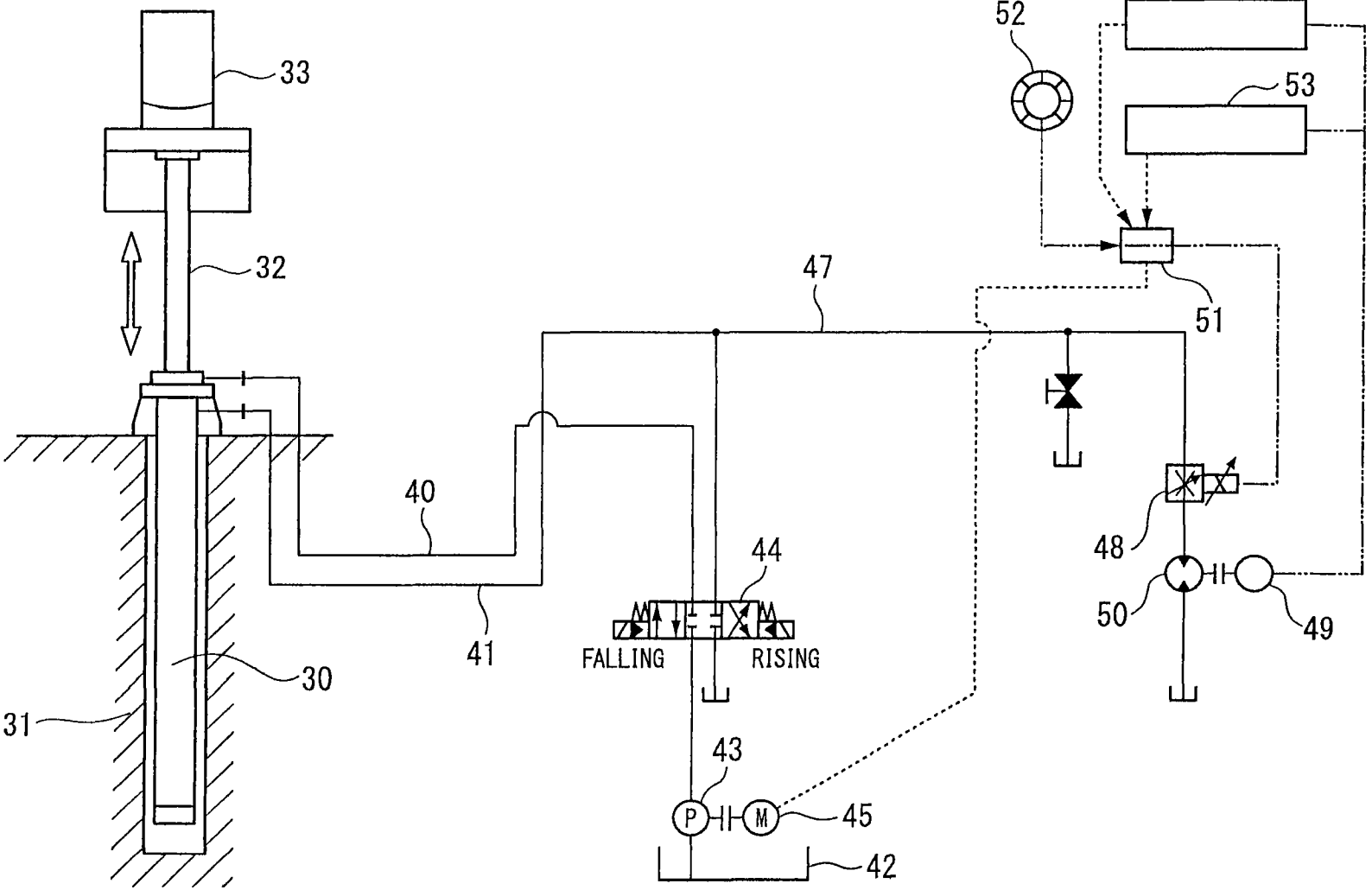
FIG. 7 is a diagram illustrating the constitution of a molding machine employing the hydraulic system according to the embodiment of the invention.

FIG. 7 shows a molding machine partially employing the hydraulic system according to the embodiment of the invention.

In the system according to this embodiment, a cylinder unit 30 is vertically disposed in a base 31 and a molding unit 33 for molding a metal product is disposed on the top end of a vertically-movable ram 32 disposed in the cylinder unit 30.

The cylinder unit 30 is connected to hydraulic pipes 40 and 41 for hydraulic driving the cylinder unit. A reservoir 42 is connected to the hydraulic pipe 40 on the supply side of hydraulic fluid via a hydraulic pump 43 and a control valve 44. A hydraulic motor 45 is connected to the hydraulic pump 43. A branch pipe 47 branched from the hydraulic pipe 41 is disposed between the control valve 44 and the cylinder unit 30. The branch pipe 47 is connected to a hydraulic motor 50 having an encoder 49 via a proportional control valve 48. A control unit 51 is connected to the proportional control valve 48. A speed setting dial 52 is mounted on the control unit 51 and information from a molding speed meter 53 and a length meter 54 is input to the control unit 51. The control information from the molding speed meter 53 and the length meter 54 is input to the encoder 49 to adjust the output of the hydraulic motor 50.

The control unit 51 can control the hydraulic pressure supplied to the cylinder unit 30 by adjusting the proportional control valve 48 and adjusting the hydraulic motor 45.

When receiving molten metal by the use of the molding unit 33 and molding a desired slab at a target molding speed, the molding machine shown in FIG. 7 causes the ram 32 of the cylinder unit 30 to vertically move and adjusts the position of the molding unit 33, based on a molding pattern programmed in advance depending on the specification of a cast slab.

In this operation, since the vertical position of the molding unit 33 is adjusted by the use of the ram 32 depending on the amount of molten metal, the weight of the molten metal acts on the ram 32 and thus it is necessary to perform the hydraulic control depending on the load acting on the ram 32, similarly to the first embodiment. Therefore, similarly to the first embodiment, the ram 32 has only to be controlled in the initial state, the proportional steady state, and the later state.

EXAMPLES

An extruding test was carried out using a 2500 USton horizontal single-drum hydraulic pressing machine (made by Ube Industries Ltd.) having the basic structure shown in FIGS. 1 to 3.

Figure 8:
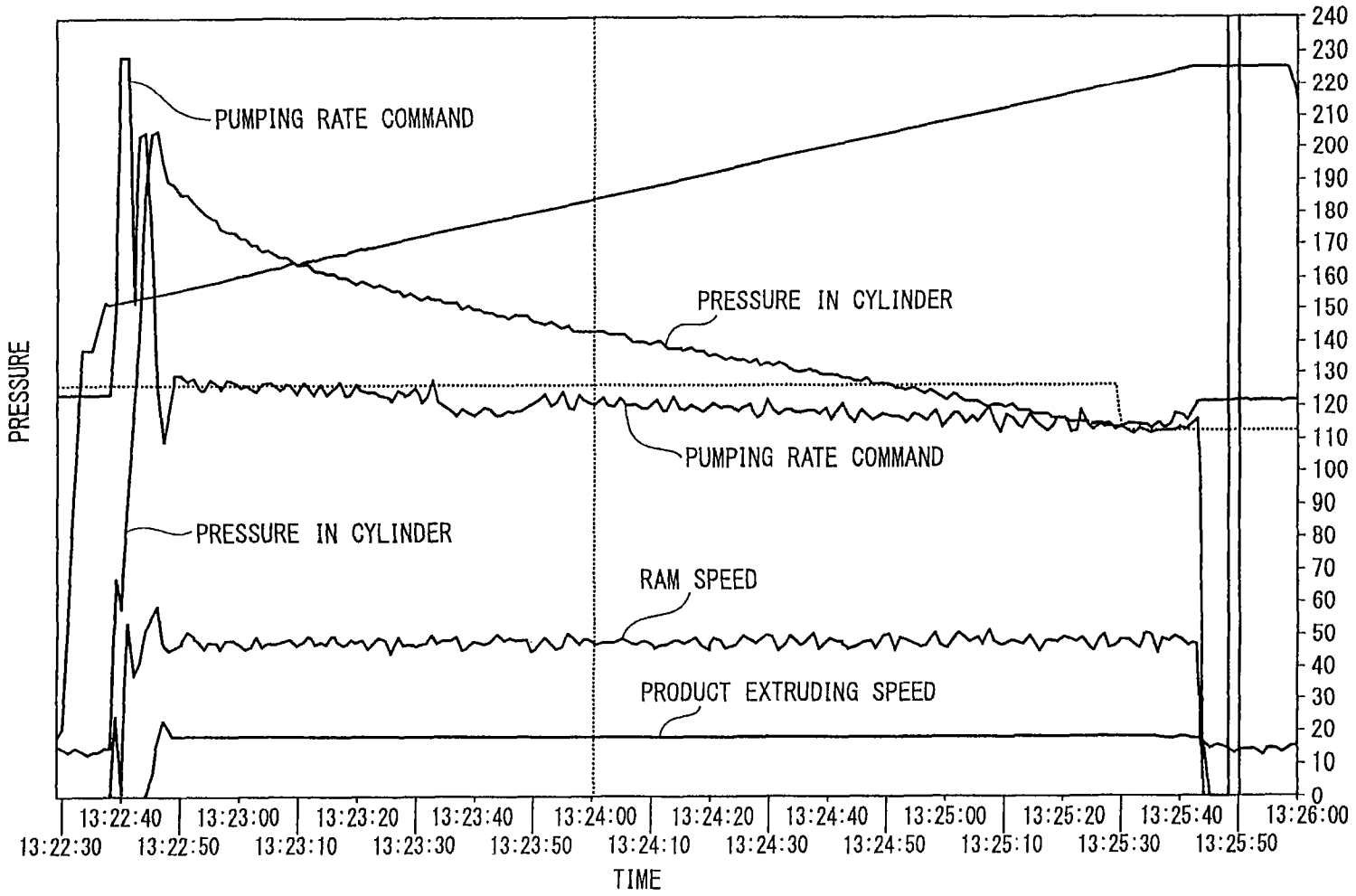
FIG. 8 is a diagram illustrating an example of the correlation between the pressure in a cylinder, the pumping rate, the ram speed, and the production speed which are obtained when a specific aluminum material is subjected to an extruding process in a state where an 80% upper limit is applied to the pumping rate of a ram cylinder unit in performing the extruding process using the extrusion device employing the hydraulic system according to the embodiment of the invention.

FIG. 8 is a diagram illustrating the relationship between the pumping rate instruction, the pressure in the cylinder, the ram speed, and the product extruding speed which are obtained when an extruding process is performed to produce an extrusion-molded product using the 6063 alloy defined in the JIS as a billet of an aluminum alloy material and using the extrusion device. In this test, an 80% upper limit is set in the pumping rate instruction so as not to raise the pumping rate any more. In this test, a pumping rate instruction with an upper limit was given until the ram speed reaches 60%.

As shown in FIG. 8, since the pumping rate was stabilized for a very short time (in approximately 6 seconds), it could be seen that the control was performed with a fast response.

Figure 9:
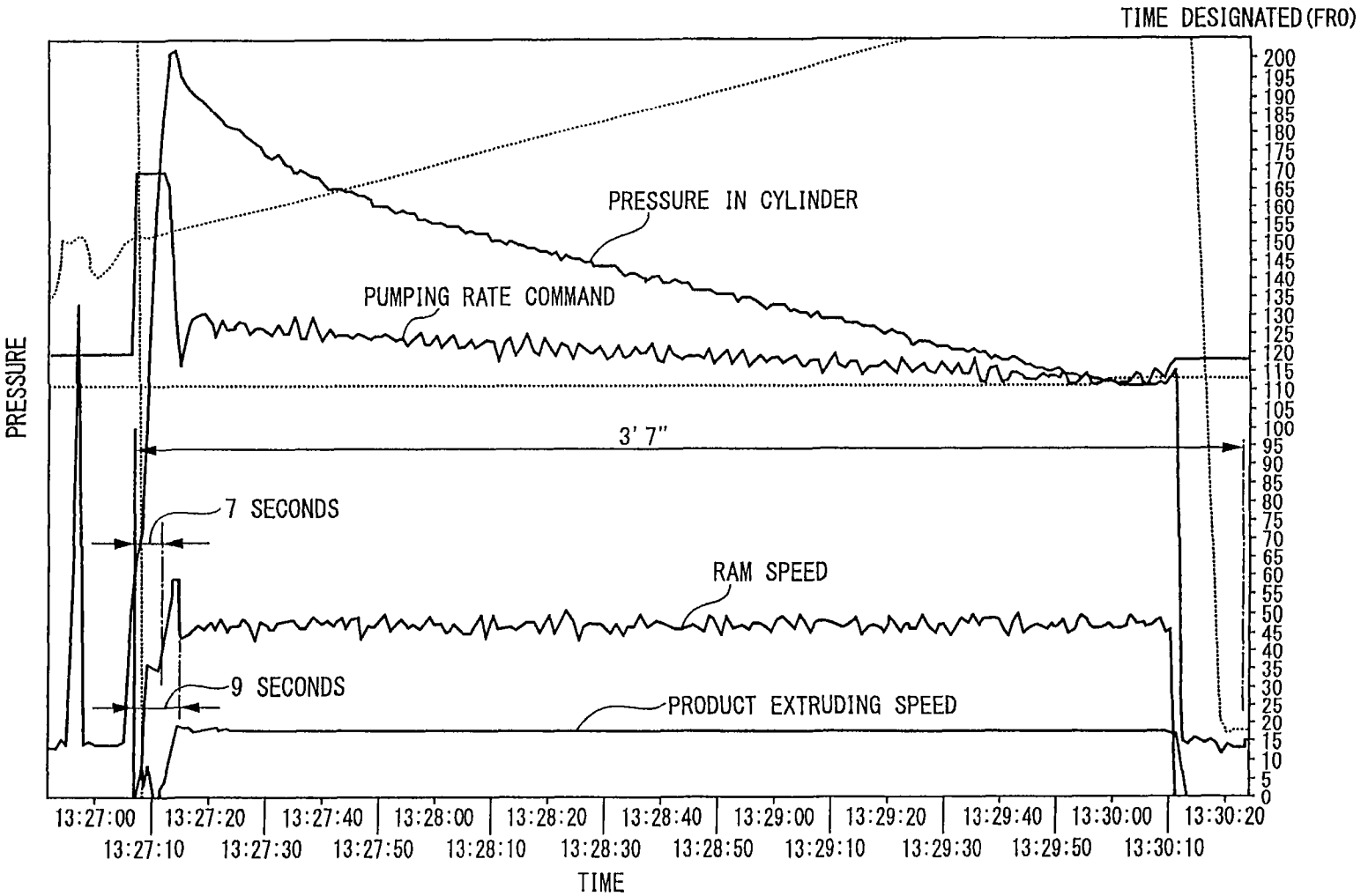
FIG. 9 is a diagram illustrating an example of the correlation between the pressure in a cylinder, the pumping rate, the ram speed, and the production speed which are obtained when a specific aluminum material is subjected to an extruding process in a state where a 60% upper limit is applied to the pumping rate of a ram cylinder unit in performing the extruding process using the extrusion device employing the hydraulic system according to the embodiment of the invention.

FIG. 9 is a diagram illustrating the relationship between the pumping rate instruction, the pressure in the cylinder, the pumping rate, the ram speed, and the product extruding speed which are obtained when an extruding process is performed to produce an extrusion-molded product using the 6063 alloy defined in the JIS as a billet of an aluminum alloy material and using the extrusion device shown in FIGS. 1 to 3. In this test, a 60% upper limit is set in the pumping rate instruction so as not to raise the pumping rate any more. Since the pumping rate was stabilized for a very short time (in approximately 9 seconds), it could be seen that the control was performed with a quick response.

Figure 10:
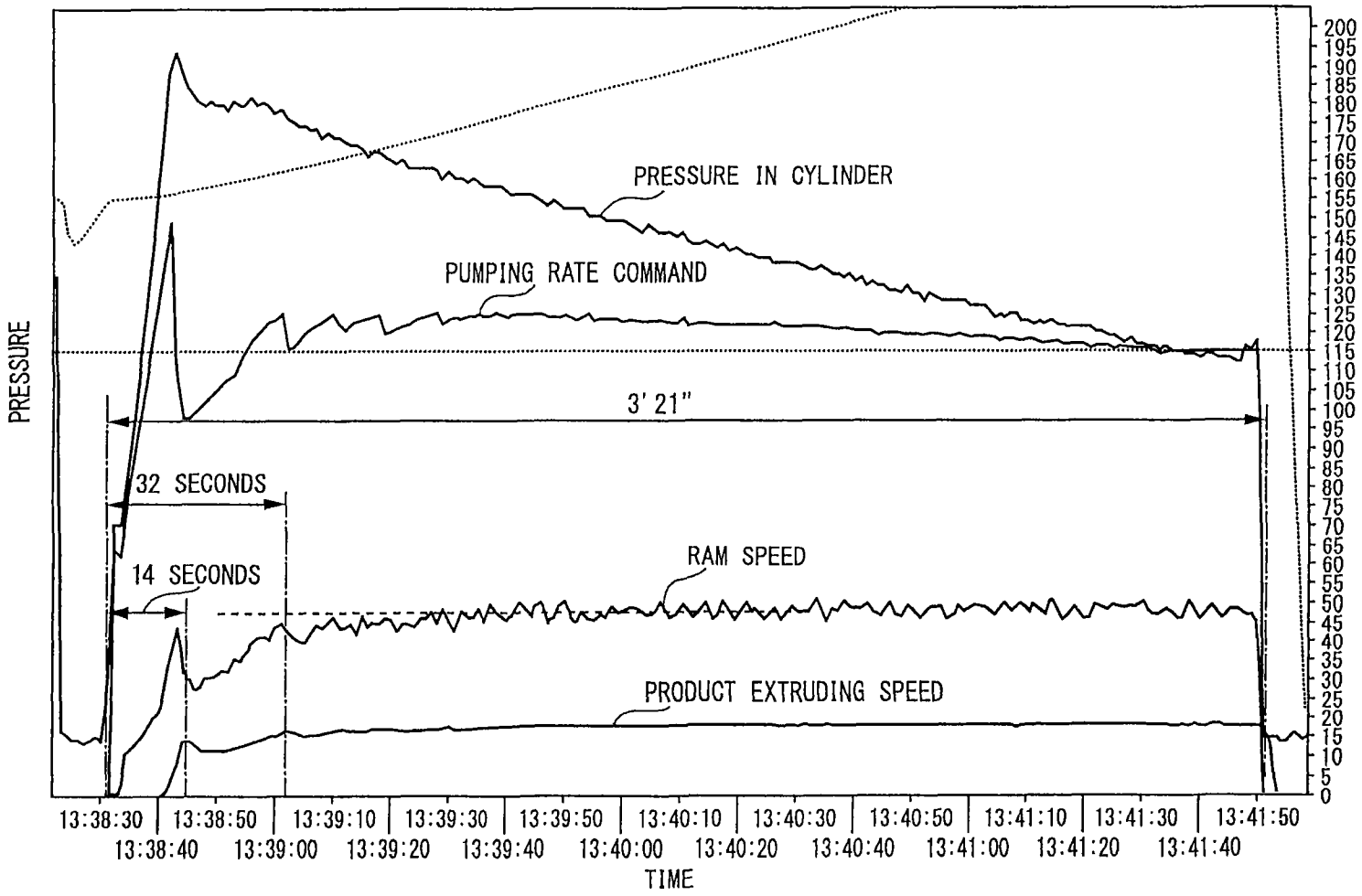
FIG. 10 is a diagram illustrating an example of the correlation between the pressure in a cylinder, the pumping rate, the ram speed, and the production speed which are obtained when a specific aluminum material is subjected to an extruding process using an extrusion device having a PID control unit according to the related art.

FIG. 10 is a diagram illustrating the relationship between the pumping rate instruction, the pressure in the cylinder, the pumping rate, the ram speed, and the product extruding speed which are obtained when an extruding process is performed to produce an extrusion-molded product using the 6063 alloy defined in the JIS as a billet of an aluminum alloy material, using the extrusion device shown in FIGS. 1 to 3, and using the PID control in the related art as the control of the hydraulic fluid supplied to the ram cylinder unit.

In this test, it could be seen that the time of approximately 32 seconds is required for stabilizing the moving speed of the ram to a certain extent. Therefore, in the test result using the control method according to the related art shown in FIG. 10, it could be seen that the longer time is required for stabilizing the moving speed of the ram than in the test result according to this embodiment shown in FIGS. 8 and 9. In the test result shown in FIG. 10, the time from the extrusion start to the extrusion end is longer than in the examples shown in FIGS. 8 and 9, and thus the productivity is lower.

While embodiments of the invention have been described above in detail with reference to the drawings, it should be understood that concrete structures are not limited to the embodiments described above, and various design modifications can be made without departing from the scope of the present invention.

What is claimed is:

1. A method of controlling a hydraulic system, the hydraulic system comprising: a ram cylinder unit having a cylinder and a ram; and a hydraulic pump and a reservoir used to supply hydraulic fluid to the cylinder, and hydraulically driving the ram using the hydraulic fluid supplied to the cylinder by the hydraulic pump so as to cause the ram to move against a specific load, wherein:

a main ram is movably received in the cylinder;

the ram unified into a front side of the main ram is disposed to be movable in an axis direction of the ram cylinder unit;

in the cylinder of the ram cylinder unit, a first pipe and a second pipe for supplying and discharging the hydraulic fluid to and from the cylinder are connected to a peripheral wall on a front side and a peripheral wall on a rear side;

the first pipe is connected to the reservoir;

the second pipe is connected to the hydraulic pump;

the hydraulic pump is attached to a portion in which the reservoir and the second pipe are connected; and the hydraulic fluid staying in the cylinder in the front side of a position of the main ram can be returned to the reservoir via the first pipe with a advancing of the main ram, the method comprising:

determining what a present state is one of an initial state, a proportional steady state, and a later state, wherein the initial state is a state where the hydraulic pump supplies the hydraulic fluid via the second pipe to the rear side of the cylinder to compress the hydraulic fluid in the cylinder and to control the moving speed of the ram by the use of the pressure of the hydraulic fluid including volume loss due to the compression, the proportional steady state is a state where a predetermined correlation is maintained depending on a pumping rate supplied to the cylinder and the moving speed of the ram is controlled after the compression of the hydraulic fluid in the cylinder is completed, and the later state is a state where the pressure decreasing by decompressing the hydraulic fluid compressed in the cylinder and by returning the hydraulic fluid to the reservoir via the second pipe and the hydraulic pump is added to the pressure of the hydraulic fluid supplied to the cylinder and the moving speed of the ram is controlled by the use of the resultant pressure;

controlling the pumping rate, which is obtained by adding the flow rate corresponding to the volume loss due to the compression of the hydraulic fluid thereto, to control the moving speed of the ram to a target ram speed in the initial state;

controlling the pumping rate, which is obtained by subtracting the flow rate corresponding to volume recovery of the hydraulic fluid due to the relief of compression of the hydraulic fluid therefrom, to control the moving speed of the ram to the target ram speed in the later state;

numerically calculating the pumping rate corresponding to the present ram speed based on the relationship between the moving speed of the ram and the pumping rate, which is expressed as the correlation in the proportional steady state which has been calculated in advance through a test under a specific load condition acting on the ram in the initial state, and calculating a pumping rate value obtained by adding the pumping rate corresponding to the target ram speed to the flow rate corresponding to the volume loss due to the compression of the hydraulic fluid thereto in the initial state corresponding to a difference between the pumping rate of the hydraulic pump in the initial state and the pumping rate corresponding to the present ram speed;

numerically calculating the pumping rate corresponding to the present ram speed based on the relationship between the moving speed of the ram and the pumping rate, which is expressed as the correlation in the proportional steady state which has been calculated in advance through the test under the specific load condition acting on the ram in the later state, and calculating a pumping rate value obtained by subtracting the flow rate corresponding to volume recovery of the hydraulic fluid due to the relief of compression of the hydraulic fluid therefrom in the later state corresponding to a difference between the pumping rate of the hydraulic pump in the later state and the pumping rate corresponding to the present ram speed from the pumping rate corresponding to the target ram speed.

2. The method of claim 1, wherein the hydraulic system is an extrusion device which includes a container unit receiving a billet of a metal material for extrusion, a die unit for extrusion disposed on the front side of the container unit, the ram cylinder unit having the cylinder and the ram disposed on the rear side of the container unit, and the hydraulic pump and the reservoir supplying the hydraulic fluid to the ram cylinder unit and in which the ram is hydraulically driven by the hydraulic fluid supplied to the cylinder by the use of the hydraulic pump so as to be advanced and retracted relative to the container unit.

3. A hydraulic system, comprising:

a ram cylinder unit having a cylinder and a ram;

a hydraulic pump and a reservoir being used to supply hydraulic fluid to the cylinder; and a control unit controlling the pumping rate of the hydraulic fluid supplied from the hydraulic pump to the cylinder, wherein:

the ram is hydraulically driven using the hydraulic fluid supplied to the cylinder by the hydraulic pump and the ram is made to move against a specific load;

a main ram is movably received in the cylinder;

the ram unified into a front side of the main ram is disposed to be movable in an axis direction of the ram cylinder unit;

in the cylinder of the ram cylinder unit, a first pipe and a second pipe for supplying and discharging the hydraulic fluid to and from the cylinder are connected to a peripheral wall on a front side and a peripheral wall on a rear side;

the first pipe is connected to the reservoir;

the second pipe is connected to the hydraulic pump;

the hydraulic pump is attached to a portion in which the reservoir and the second pipe are connected;

the hydraulic fluid staying in the cylinder in the front side of a position of the main ram can be returned to the reservoir via the first pipe with a advancing of the main ram;

the control unit determines what a present state is one of an initial state, a proportional steady state, and a later state, where the initial state is a state where the hydraulic pump supplies the hydraulic fluid via the second pipe in the rear side of the cylinder to compress the hydraulic fluid in the cylinder and to control the moving speed of the ram by the use of the pressure of the hydraulic fluid including volume loss due to the compression, the proportional steady state is a state where a predetermined correlation is maintained depending on a pumping rate supplied to the cylinder and the moving speed of the ram is controlled after the compression of the hydraulic fluid in the cylinder is completed, and the later state is a state where the pressure decreasing by decompressing the hydraulic fluid compressed in the cylinder and by returning the hydraulic fluid to the reservoir via the second pipe and the hydraulic pump is added to the pressure of the hydraulic fluid supplied to the cylinder and the moving speed of the ram is controlled by the use of the resultant pressure;

the control unit controls the pumping rate, which is obtained by adding the flow rate corresponding to the volume loss due to the compression of the hydraulic fluid thereto, to control the moving speed of the ram to a target ram speed in the initial state;

the control unit controls the pumping rate, which is obtained by subtracting the flow rate corresponding to volume recovery of the hydraulic fluid due to the relief of compression of the hydraulic fluid therefrom, to control the moving speed of the ram to the target ram speed in the later state;

wherein the control unit numerically calculates the pumping rate corresponding to the present ram speed based on the relationship between the moving speed of the ram and the pumping rate, which is expressed as the correlation in the proportional steady state which has been calculated in advance through a test under a specific load condition acting on the ram in the initial state, and calculates a pumping rate value obtained by adding the pumping rate corresponding to the target ram speed to the flow rate corresponding to the volume loss due to the compression of the hydraulic fluid thereto in the initial state corresponding to a difference between the pumping rate of the hydraulic pump in the initial state and the pumping rate corresponding to the present ram speed; and wherein the control unit numerically calculates the pumping rate corresponding to the present ram speed based on the relationship between the moving speed of the ram and the pumping rate, which is expressed as the correlation in the proportional steady state which has been calculated in advance through the test under the specific load condition acting on the ram in the later state, and calculates a pumping rate value obtained by subtracting the flow rate corresponding to volume recovery of the hydraulic fluid due to the relief of compression of the hydraulic fluid therefrom in the later state corresponding to a difference between the pumping rate of the hydraulic pump in the later state and the pumping rate corresponding to the present ram speed from the pumping rate corresponding to the target ram speed.

4. The hydraulic system of claim 3, wherein the hydraulic system is an extrusion device which includes a container unit receiving a billet of a metal material for extrusion, a die unit for extrusion disposed on the front side of the container unit, the ram cylinder unit having the cylinder and the ram disposed on the rear side of the container unit, and the hydraulic pump and the reservoir supplying the hydraulic fluid to the ram cylinder unit and in which the ram is hydraulically driven by the hydraulic fluid supplied to the cylinder by the use of the hydraulic pump so as to be advanced and retracted relative to the container unit.

* * * * *